United States Patent [19]

Vogt et al.

[11] Patent Number: 4,974,913

[45] Date of Patent: Dec. 4, 1990

[54] WORK-STATION ARRANGEMENT

[75] Inventors: Franz Vogt, Pohlheim; Rainer Machate, Biebertal, both of Fed. Rep. of Germany

[73] Assignee: VOKO Franz Vogt & Co., Polheim, Fed. Rep. of Germany

[21] Appl. No.: 415,052

[22] Filed: Sep. 29, 1989

[30] Foreign Application Priority Data

Oct. 3, 1988 [DE] Fed. Rep. of Germany ... 8812473[U]

[51] Int. Cl.[5] ..... A47B 17/00

[52] U.S. Cl. ..... 312/195; 108/143

[58] Field of Search ..... 312/195, 256; 52/731; 248/225.1, 165; 108/137, 143, 102

[56] References Cited

U.S. PATENT DOCUMENTS

| | | | |
|---|---|---|---|
| 3,562,992 | 2/1971 | Kinsey | 52/731 X |
| 3,815,311 | 6/1974 | Nisula et al. | 52/73 X |
| 4,163,537 | 8/1979 | Mourgue | 312/195 X |
| 4,192,119 | 3/1980 | Murphy | 52/731 X |
| 4,382,642 | 5/1983 | Burdick . | |
| 4,542,614 | 9/1985 | Malachowski | 52/731 |
| 4,748,913 | 6/1988 | Favaretto et al. | 312/195 X |
| 4,841,708 | 6/1989 | Johnston | 52/646 |

*Primary Examiner*—Joseph Falk

*Attorney, Agent, or Firm*—Flynn, Thiel, Boutell & Tanis

[57] ABSTRACT

The invention relates to a work-station arrangement, in which a number of components can be secured on a longitudinal girder. The longitudinal girder has substantially a rectangular hollow profile, at the corners of which are provided longitudinal grooves, which preferably widen toward the inside of the longitudinal girder. Furthermore, a central carrier pipe is provided, which is constructed integrally with the longitudinal girder through bracings. A fastening groove can be provided at least on one side of the girder, which groove has tooth systems on its walls for threadedly receiving screws. The components have hook-shaped holding elements attached thereto and insertable into the longitudinal grooves for securing the components to the girder.

23 Claims, 9 Drawing Sheets

FIG. 2
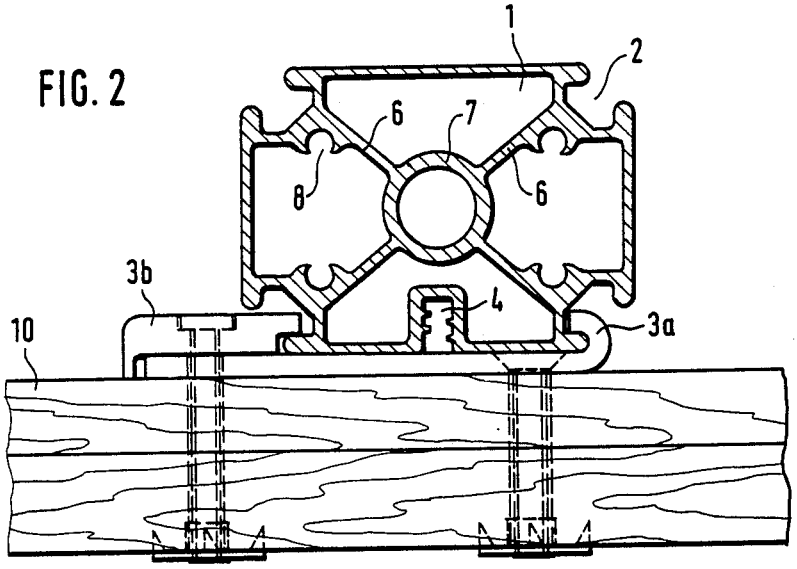
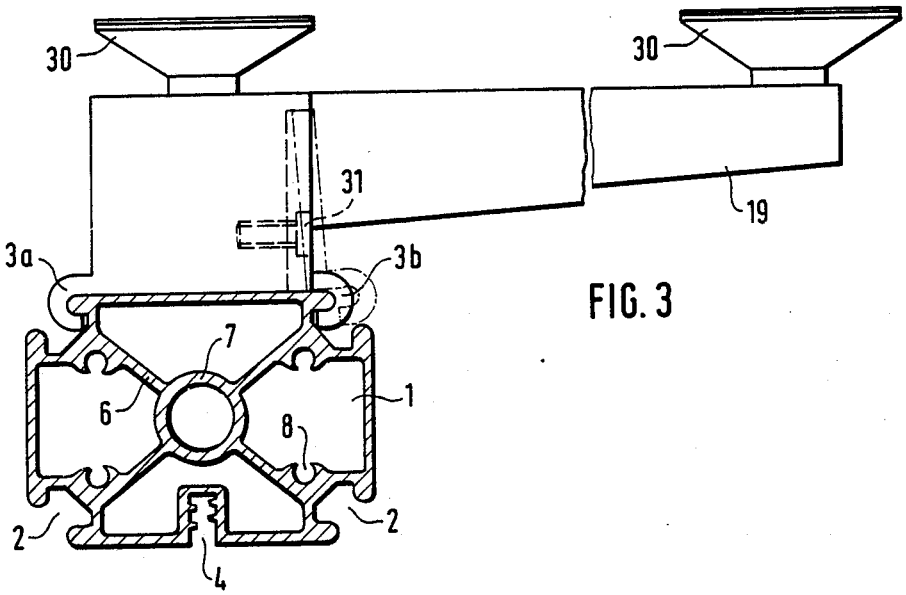
FIG. 3

WORK-STATION ARRANGEMENT

FIELD OF THE INVENTION

The invention relates to a work-station arrangement comprising a longitudinal girder, with which components are connected.

BACKGROUND OF THE INVENTION

A work-station arrangement of the described type is known from German OS No. 31 35 576 (corresponding to U.S. Pat. No. 4,382,642). The longitudinal girder in this work-station arrangement is constructed in the form of a profiled support rod having substantially a x-shaped cross section. Components can be clamped or fastened on the support rod such that each two adjacent legs of the x-shaped profile are embraced by a clamping mechanism. It is disadvantageous in this arrangement that only one clamping mechanism each can be mounted on one longitudinal area of the longitudinal girder, so that the number of components, which can be fastened thereon, is very limited. In particular, it is not possible to secure several components by means of separate clamping mechanisms on the same longitudinal area of the longitudinal girder. This has the consequence that a mounting of components is not possible, in which they are supposed to be mounted substantially in one plane transversely with respect to the longitudinal axis of the longitudinal girder. Thus, it is for example not possible to arrange cable channels or cable chutes in alignment with other components, for example the feet of a pedestal. Thus, design modifications for these building-block-type work-station arrangements are very limited, in particular many arrangements of the components desired for reasons of design are not possible.

The basic purpose of the invention is to create a work-station arrangement of the above-mentioned type, which with a simple design and strong construction permits any desired arrangement of the components.

SUMMARY OF THE INVENTION

This purpose is attained according to the invention by the longitudinal girder being of a rectangular hollow cross-sectional profile and having longitudinal grooves constructed at its corners, which longitudinal grooves extend toward the inside of the longitudinal girder and into which hook-shaped holding elements can be inserted, which holding elements are each connected to a component.

The inventive rectangle hollow profile girder has a number of significant advantages. For design reasons it is advantageous, that the longitudinal girder, aside from the longitudinal grooves, has a substantially box-shaped or beam-shaped appearance and thus can be integrated optically particularly well into the entire design of the work-station arrangement. Since the longitudinal grooves, into which the hook-shaped holding elements can be moved, are provided at the corners of the rectangle hollow profile, there exists on the one hand the advantage, that the longitudinal grooves only insignificantly influence the optical appearance and that on the other hand the longitudinal girder has large contact surfaces available on its outer edges, by means of which a secure and tilt-resisting connection with the components is possible.

A particularly advantageous development of the invention provides, that the longitudinal groove is dimensioned such, that two holding elements can be simultaneously suspended at the same area of the longitudinal groove. Thus, it is possible according to the invention, that components can be mounted on the same longitudinal area of the longitudinal girder on all four sides of the longitudinal girder. Thus, it is for example possible to arrange several components extending in a vertical direction in alignment with one another in a plane transversely with respect to the rectangular profile of the longitudinal girder. Furthermore, the possibility exists according to the invention to secure a plurality of additional components on the longitudinal girder, even when already several other components are supported on a specific area of the longitudinal girder. From this results the possibility to construct the hook-shaped holding elements with a sufficient width, which can significantly increase the solidity and stability of the entire work-station arrangement.

Each component includes preferably two holding elements, which can be suspended in adjacent longitudinal grooves. Thus, it is possible to rest one component against one side of the longitudinal girder and to suspend the associated holding elements each in the longitudinal grooves which define therebetween the side of the longitudinal girder.

A further, particularly advantageous development of the longitudinal girder of the invention is, that same is provided with a longitudinal fastening groove in the center of at least one side surface thereof, the walls of which fastening groove are provided with a longitudinal tooth system for threadedly receiving thread bolts. This type of development additionally makes it possible to secure, independent from the holding elements, further components on the longitudinal girder, for example components with a light weight, such as smaller brackets for telephones, dictating machines or others. In order to be able to fasten additional components also on the front ends of the longitudinal girder, there is arranged, in the central area of the longitudinal girder, a support pipe connected to the walls of the longitudinal girder by means of bracings and extending over the entire length of the longitudinal girder. Spreadable or wedgable fastening elements can be inserted into the support pipe. Components are fastened to the fastening elements. Thus, it is for example possible to secure in this manner a mounting frame on the longitudinal girder, which frame includes a vertical arm extending above the girder. A horizontal arm for suspending further elements is supported on the vertical arm. Thus, it is for example possible to place additional paper storage compartments or others, by means of the mounting frame, above a desk top supported on the girder. It is also possible to fasten by means of the support pipe lateral cover plates, cover elements or others on the longitudinal girder.

A further, particularly advantageous development of the invention, provides that the longitudinal girder has on its inside at least one holding groove extending over its length. The holding groove can have a partially circular cross section and can be constructed such that screws can be screwed into the holding groove. The partially circular cross section proves to be especially advantageous particularly in view of the manufacture of the longitudinal girder, since same is produced preferably by an extrusion process and since the manufacture of very small closed hollow cross sections requires a high production-technical input. Whereas a partially circular cross section can be manufactured easier, but has still a sufficient solidity for screwing in a screw. It is for example possible by means of these holding grooves to connect several work-station arrangements with one another, either by an aligning association of the individual longitudinal girders or by using additional angle elements.

The components are preferably constructed such that a first holding element is mounted fixedly on the component, while a second holding element, which is associated with the first holding element, is supported releasably on the component. The second holding element can be initially tensioned for example by means of a screw. This development makes it possible to secure or loosen the components individually on or from the longitudinal girder without the necessity of demounting other components. An alternative makes it possible to support both holding elements each releasably on the component, for example for fastening a component having a closed cross section, for example a base for the work-station arrangement.

The inventive work-station arrangement is preferably designed such that several pedestals are attached to the underside of the longitudinal girder. Furthermore, it can be advantageous to mount at least one drawer or cabinet element on the underside of the longitudinal girder. A cable-chute element can be provided on the rear side of the longitudinal girder, which cable-chute element extends over the entire length of the longitudinal girder. If the holding groove provided with a threaded tooth system is constructed on the underside of the longitudinal girder, it is possible to provide, as already mentioned, an additional bracket or shelf on the underside. The upper side of the longitudinal girder can, according to the invention, be used for mounting a supporting bracket to support a desk top. However, the supporting bracket can also be secured on the front side of the longitudinal girder.

The above-mentioned cable-chute element can be constructed according to the invention such that it includes a back-wall element connectable to the longitudinal girder, on which back-wall element are secured the holding elements, which can be introduced into the longitudinal grooves. Furthermore, the cable-chute element can include a bottom element, which can, for example, be connected to the back-wall element or can be suspended in same. In order to assure, even in the mounted state, an easy access to the cable-chute element, it can be provided, that same includes a lid element, which is supported tiltably on the rear-wall element by means of a hinge. To prevent the individual elements of the cable-chute element from coming loose from one another, it can be advantageous to use a clamping element, which embraces the respective individual elements or all of the individual elements of the cable-chute element. The clamping element can only be mounted only at the end areas of the cable-chute element in order to guarantee a sufficient solidity.

The bottom element of the cable-chute element can be provided with several separate cable channels, so that separations of low-voltage cables and high-voltage cables is possible. Furthermore, a sufficient shielding is possible by constructing the bottom elements of a metallic material.

To permit an elevational adjustment of the desk top, the supporting bracket can include according to the invention several selectively usable, vertically arranged superposed spacer elements for the elevational adjustment. Thus, it is possible to change the height of the desk top within a certain range, without changes of the base element or the utilization of another base element.

According to the invention it can furthermore be particularly advantageous, when a support rail is supported on the supporting bracket, which support rail is movable in longitudinal direction of the supporting bracket and is connected to the desk top. Thus, it is possible to move the desk top relative to the longitudinal girder, namely transversely to same in order to, for example, make access to the cable-chute element easier, which cable-chute element is in the normal operating position covered by the desk top. In order to secure an easy movement of the support rail also in the case of a relatively heavy desk top, same can be supported on the supporting bracket by means of a roller-cage guideway, which is, for example, integrated with a dovetailed guide rail. In addition, locking devices can be provided to avoid an unintended movement of the desk top.

Furthermore, vertical channel elements arranged under the cable-chute element and adjoining same can be provided for guiding the cable to the cable-chute element. The channel elements can, for example, be in alignment with the base elements Thus, it is possible to guide the cable directly therethrough into the cable-chute element from floor connections, without the cable being visible from outside.

BRIEF DESCRIPTION OF THE DRAWINGS

The invention will be described hereinafter in connection with exemplary embodiments and the drawings, in which:

FIG. 2 is a cross-sectional view of the inventive longitudinal girder and component secured on the longitudinal girder;

FIG. 3 is a cross-sectional view of the longitudinal girder with a further component;

DETAILED DESCRIPTION

Figure 1:
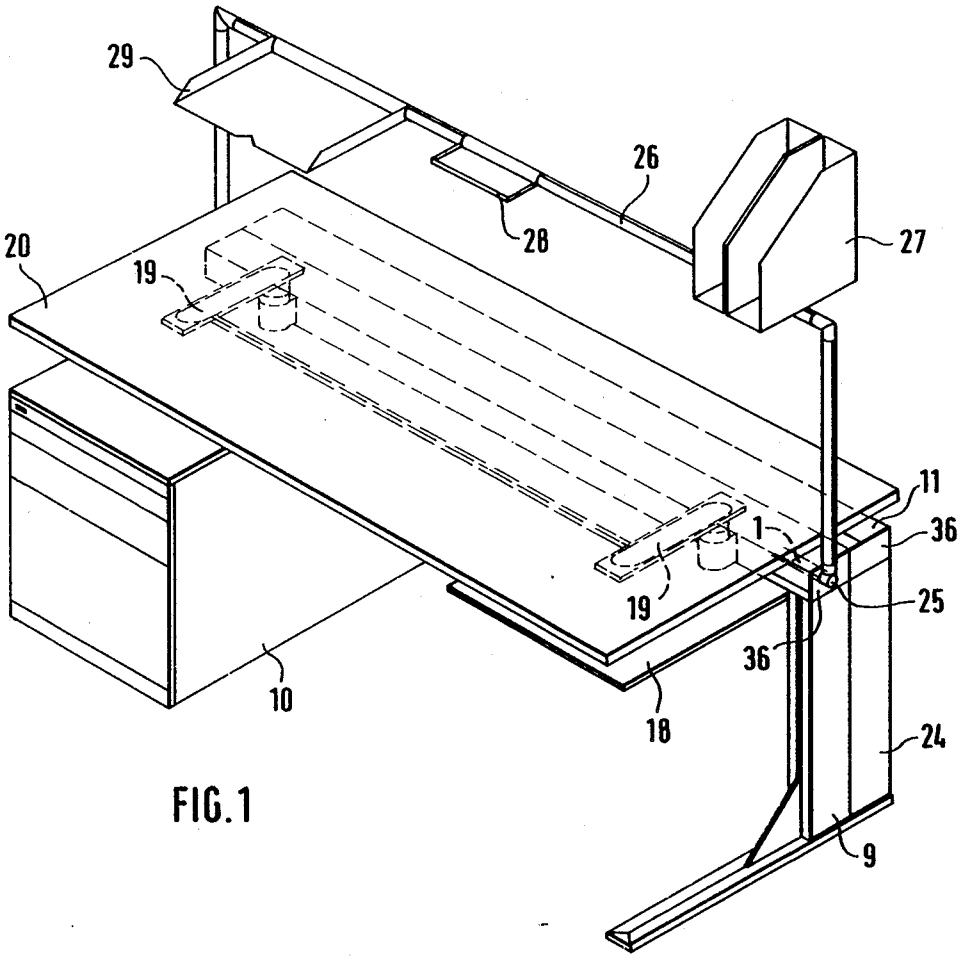
FIG. 1 is a perspective view of a first exemplary embodiment of an inventive work-station arrangement.

FIG. 1 shows a perspective illustration of the inventive work-station arrangement. It includes in the illustrated embodiment a pedestal 9, which includes a horizontal base and a vertically extending support connected to the horizontal base. As reinforcement it is possible to provide, as shown, a plate-shaped bracing. The pedestal 9 is connected at its upper end to a longitudinal girder 1, which will be described in detail later on. The work-station arrangement has a drawer or cabinet element 10 on the opposite side, which drawer element is also connected to the longitudinal girder 1. A bracket 18 is secured on the underside of the longitudinal girder 1. The upper side of the longitudinal girder 1 is connected to supporting brackets 19, on which the desk top 20 is arranged. Vertical members of a mounting frame 26 are fastened by means of clamping elements 25 to the free ends of the longitudinal girder 1, which frame 26 includes a horizontal member extending between the vertical members and on which storage units 27 to 29 are provided.

A cable-chute element 11 is provided underneath the desk top 20 on the rear side of the longitudinal girder 1, which element 11 will also be described in detail later on. The ends of the cable-chute element 11 are connected to a channel element 24, which is arranged on the base of the pedestal 9 and behind the support thereof, and through which cable can be introduced from a floor connection into the cable-chute element 11.

FIG. 2 is a cross-sectional view of the inventive longitudinal girder 1. Same is constructed in the form of a substantially rectilinear hollow profile, on the corners of which longitudinal grooves 2 are provided, which enlarge (widen) toward the inside of the longitudinal girder 1. A support pipe 7 having a circular cross section is arranged in the center area of the longitudinal girder 1, which support pipe 7 is connected to the corner portions of the outside walls of the longitudinal girder 1 by means of bracings (or bracing members) 6. The clamping elements 25 are insertable into the ends of the support pipe 7 to thereby fasten the mounting frame 26 to the girder 1.

Figure 6:
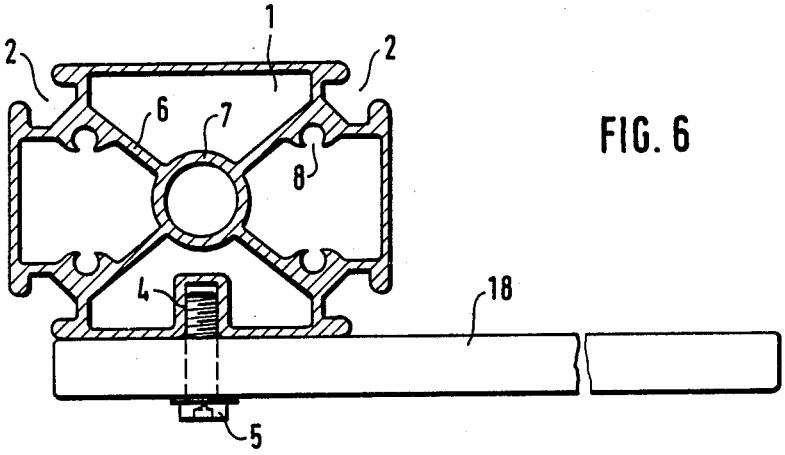
FIG. 6 is a further cross-sectional view of the inventive longitudinal girder with a further component.

A fastening groove 4 exists on the underside of the longitudinal girder 1, the fastening groove 4 extending over the length of the girder 1. The walls of the fastening groove 4 have longitudinal tooth systems, only schematically illustrated in FIG. 2, so that it is possible to threadedly engage a screw at any point into the fastening groove 4 in order to, as this is shown in FIG. 6, fasten the bracket 18 on the longitudinal girder 1 by means of thread bolts 5. The bracket 18 (or shelf) can be utilized for example to support a printer, dictating equipment or others. The bracket or shelf 18 can selectively also be constructed with a vertical stepped portion in order to space the support surface thereof farther below the desk top 20.

Holding grooves 8 are constructed in the bracings 6. The holding grooves 8 have a partially circular cross section and are dimensioned such, that it is possible to move screws or thread-bolt elements into the holding groove 8 in the longitudinal direction of the longitudinal girder 1. The holding groove 8 is used to connect the front side of several longitudinal girders 1 with one another or to develop work-station arrangements combined through angle pieces.

The longitudinal girder 1 is preferably manufactured by means of an extrusion process from a metallic material, for example an aluminum alloy. The bracings 6 and support pipe 7 are preferably integral with the outside walls of the girder 1.

As shown in FIG. 2, it is possible according to the invention to introduce holding elements **3*a* and 3*b* into the longitudinal grooves 2, which holding elements 2 are constructed hook-shaped. The drawer element 10 is secured on the underside of the longitudinal girder 1 in the illustrated exemplary embodiment, so that for example the drawer element 10 itself can serve as support for the longitudinal girder 1. However, it is also possible to suspend the drawer element 10 on the longitudinal girder 1**.

As shown in FIG. 2, an arm, for example the drawer element 10, can include a first holding element **3*a*, which is connected fixedly to the arm. A second holding element 3*b* is supported releasably on the arm and can be pretensioned or released using a screw or a similar fastening element. Thus, it is possible to mount or remove the components independently from one another on or from the longitudinal girder 1**.

A further exemplary embodiment is illustrated in FIG. 3, in which a supporting bracket 19 is secured on the upper side of the longitudinal girder 1. The upper side of the bracket 19 has supporting bases 30, onto which a desk top, for example a glass plate, can be placed. The bracket 19 has a first holding element **3*a*, which is integral with the bracket 19, and a second holding element 3*b*, which can be screwed to the bracket 19 by a screw 31 after the holding element 3*a* has been moved into the longitudinal groove 2, the holding element 3*b* also being inserted into an adjacent longitudinal groove 2**.

Figure 4:
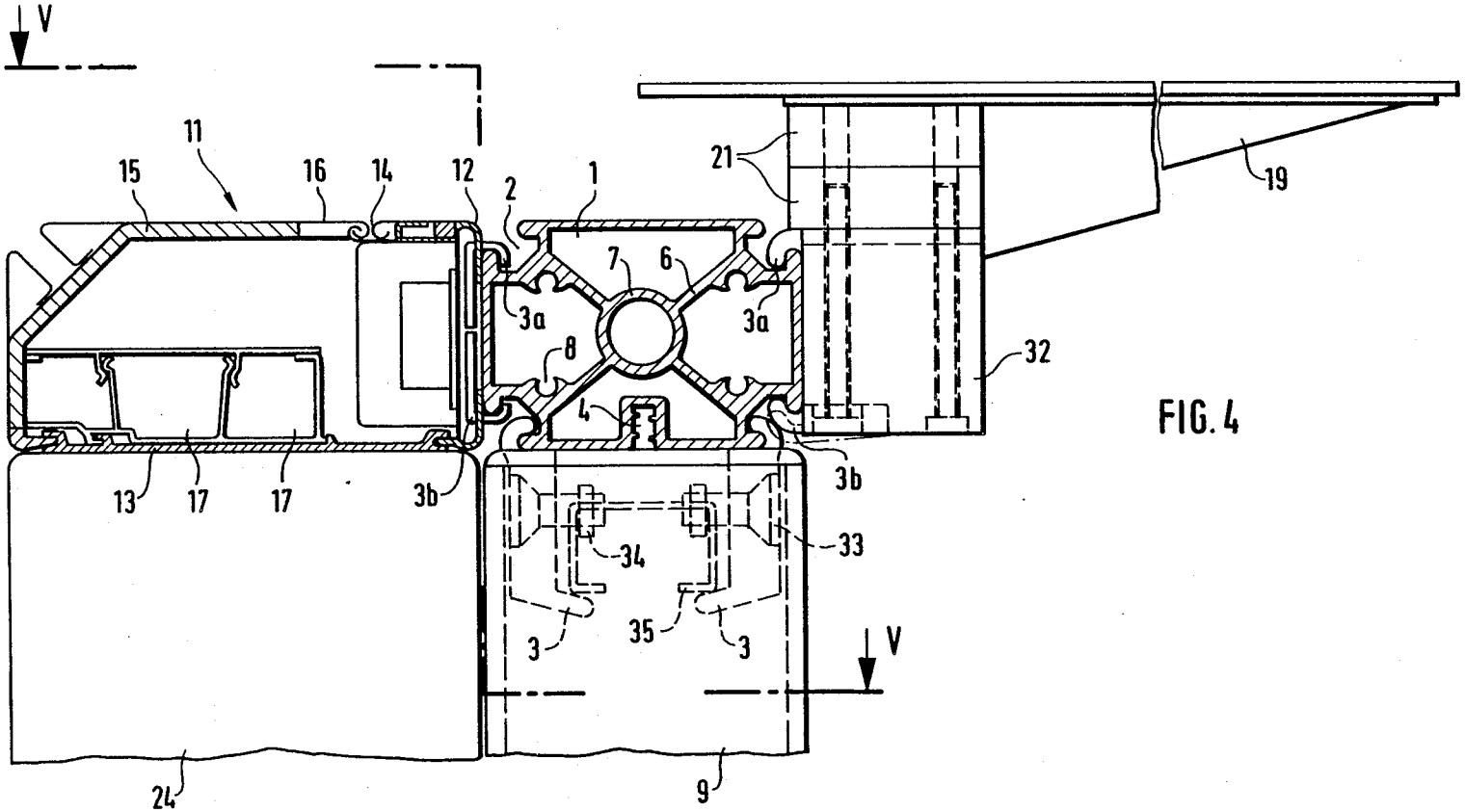
FIG. 4 is a further cross-sectional view of the longitudinal girder, in which further components are illustrated.
Figure 7:
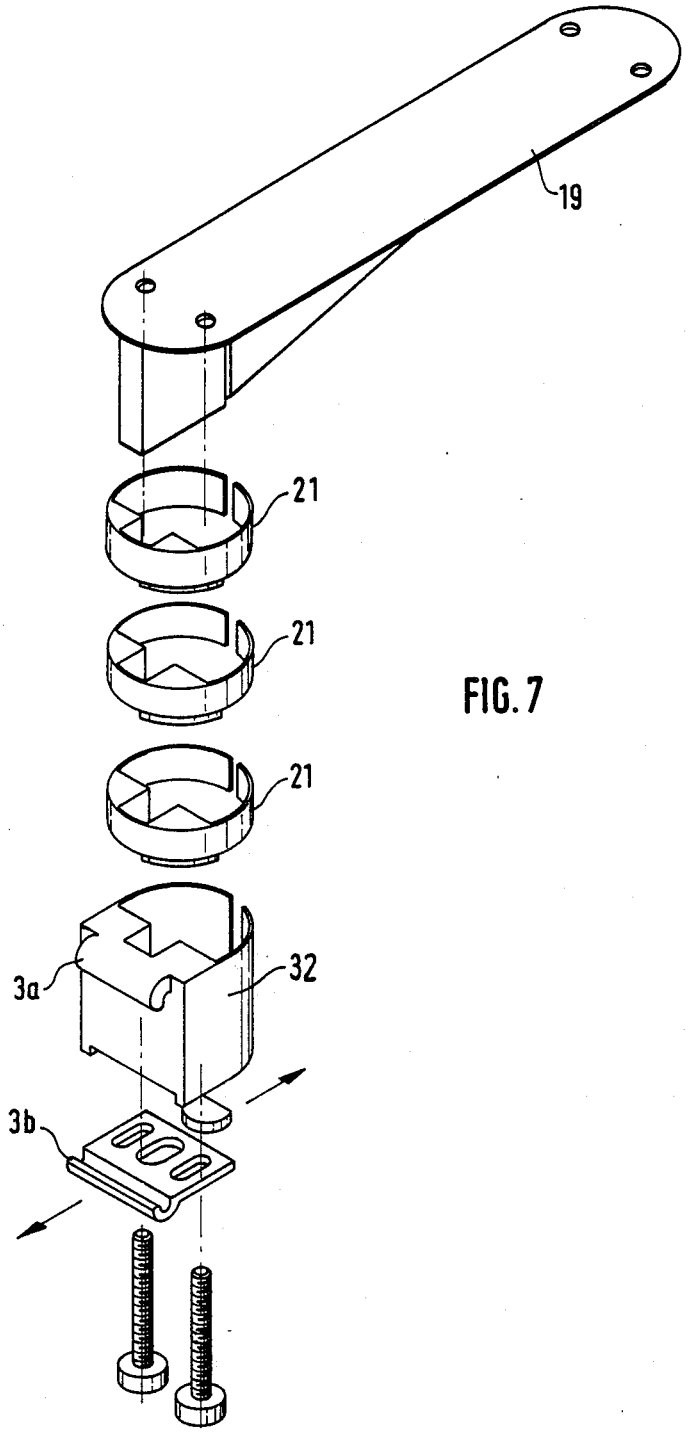
FIG. 7 is a perspective illustration of an inventive supporting bracket.

FIG. 4 illustrates a further inventive exemplary embodiment, in which a support element 32 is secured on the right side of the longitudinal girder 1. The support element 32 includes a first holding element **3*a*, which is integral therewith, and a releasable second holding element 3*b* which holding elements 3*a* and 3*b* are inserted into adjacent longitudinal grooves 2. Several spacer elements 21 are secured on the support element 32, as shown in FIG. 7, with the bracket 19 resting on the spacer elements 21. By selecting a suitable number of spacer elements 21 it is possible to adjust the height of the desk top 20** in a desired range.

FIG. 4 shows that the underside of the longitudinal girder 1 is connected to the pedestal 9, with the pedestal 9 including several holding elements 3 releasably provided thereon. The holding elements 3 can each be connected through a screw 33 and a nut 34 lying on the inside to the pipe profile of the pedestal 9. To avoid, in the released state, a falling off of the nut 34 and of the holding elements 3, an additional sheet-metal holder 35 is provided.

The cable-chute element 11 is secured on the left side of the longitudinal girder 1 illustrated in FIG. 4, which element 11 also includes an upper, first holding element **3*a*, which is secured fixedly on the cable-chute element 11, and a lower, second holding element 3*b*, which can be secured by means of screws (not illustrated). The holding elements 3*a* and 3*b* are received in the grooves 2** as discussed above.

The cable-chute element 11 has a back-wall element 12, on which the just described holding elements **3*a*, 3*b* are supported, a bottom element 13, which can be inserted into or connected to the back-wall element 12 and includes several separate cable channels 17. The cable-chute element 11 includes furthermore a lid element 15, which is hingedly connected to the back-wall element 12 by a hinge 14. Thus it is possible to open the lid element 15 without removing the cable-chute element 11**.

Figure 10:
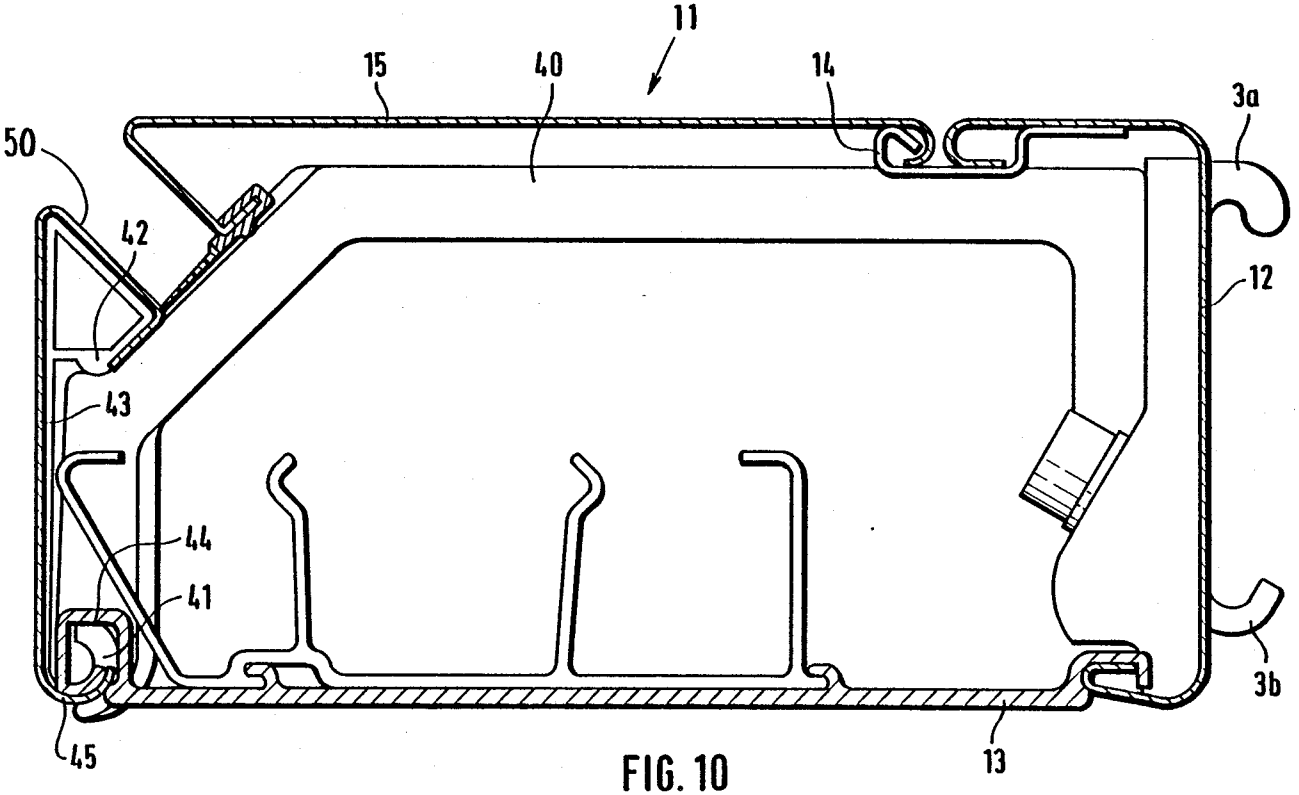
FIG. 10 is an enlarged horizontal cross-sectional view of a portion of FIG. 4.

Referring to FIG. 10, a front-wall support element 40 is arranged on each of the two sides of the back-wall element 12, which front-wall element 40 extends over a short length (about 1 cm) of the back-wall element 12. The lid element 15 and a front-wall element 43 are supported on the front-wall support elements 40. The bottom element 13, which is suspended with its one side on the back-wall element 12, engages with its other side, which is provided with a groove 44, a nose 41 of the front-wall element 43. The bottom element 13 is in its front part held exclusively by the front-wall element 43. The bottom element 13 is constructed slightly shorter than the table length and thus cable-channel length, so that same can be moved along the cable channel for the amount of this length difference, so that lines or cables can be introduced from below into the cable-chute element 11, without the necessity of removing any parts of the cable-chute element. If the bottom element is supposed to be taken out, then only the front-wall element 43 needs to be pulled off.

The support elements 40 extend from the ends of the back-wall element 12 in cantilever fashion and generally parallel to the bottom element 13. An end portion of each support element 40 opposite the back-wall element 12 inclines toward the bottom element 13. The inclined end portion has a lip at 42 which engages the front-wall element 43 at a hooked end 50 thereof opposite its nose 41. Each support element 40 terminates in an end wall extending downwardly from the lip 42 and parallel to the back-wall element 12.

The channel element 24 is provided below the cable-chute element 11. A cable can be fed from the channel element 24 to the cable-chute element 11.

It is possible, as shown in FIG. 4, to secure several components in a plane transverse to the rectangular cross-sectional profile of the longitudinal girder 1, that is, parallel to the bracings 6, since the longitudinal grooves 2 are each constructed such, that two holding elements 3 can be moved into the longitudinal grooves 2.

Figure 5:
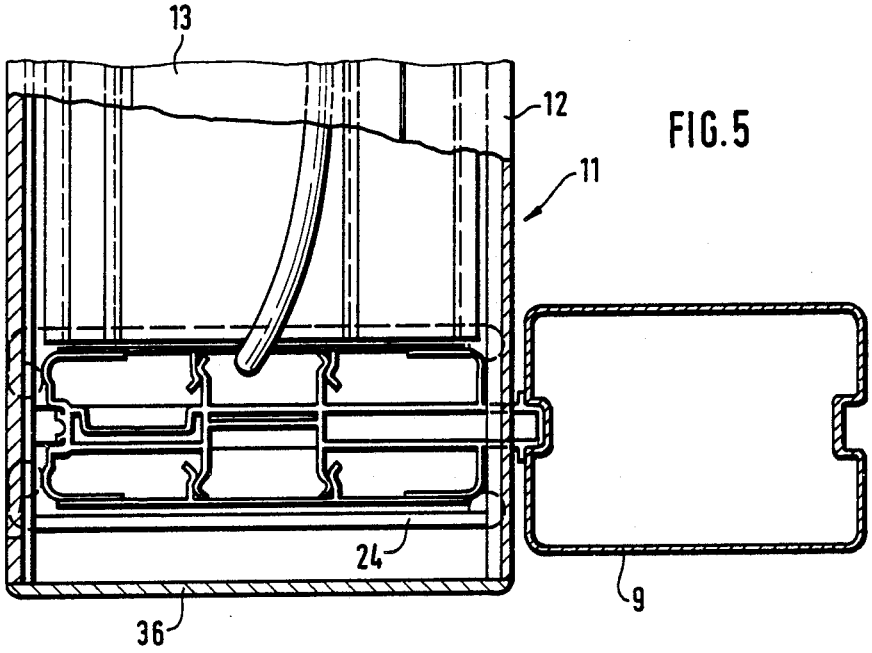
FIG. 5 is a cross-sectional view along the line V—V of FIG. 4.

FIG. 5 is a cross-sectional view along the line V—V of FIG. 4. It can thereby be recognized, that the pedestal 9 has a substantially closed cross-sectional profile. Furthermore, the channel element 24 can be seen in cross section. The channel element 24 also consists of several cable channels not individually identified with reference numerals. Furthermore, FIG. 5 shows, that the cable-chute element 11, just like the longitudinal girder 1, can be closed off on the front side by means of a cover 36 (see also FIG. 1).

Figure 8:
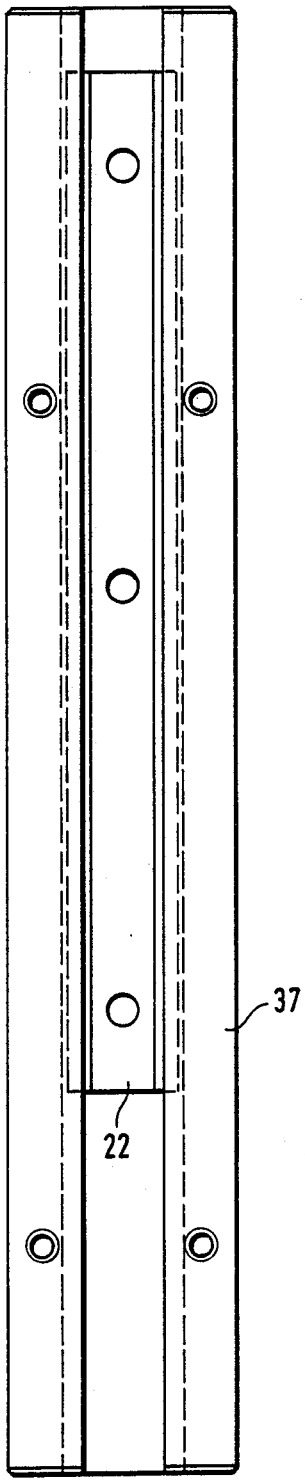
FIG. 8 is a top view of a further exemplary embodiment of the supporting bracket.
Figure 9:
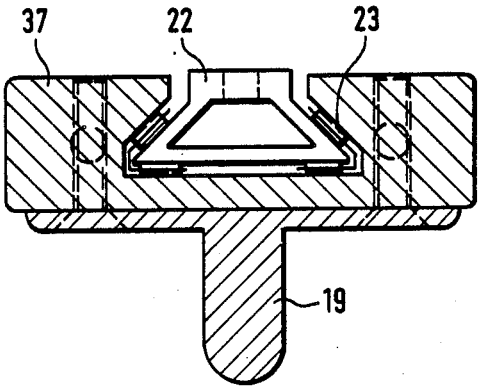
FIG. 9 is a cross-sectional view of the supporting bracket shown in FIG. 8.

FIG. 8 illustrates a top view of a further exemplary embodiment of the supporting bracket 19, and FIG. 9 is a cross-sectional view of the exemplary embodiment illustrated in FIG. 8. The supporting bracket 19 carries at its upper side a rail element 37 having a dovetail guideway in its center, in which a carrier rail 22 is longitudinally movable relative to the bracket 19. In order to make the moving easier, a roller-cage guideway 23 is provided to slidably support the rail 22. With the desk top 20 supported on carrier rails 22 on the supports 19, it is possible in this exemplary embodiment to move the desk top a specific distance transversely with respect to the longitudinal axis of the longitudinal girder 1, in order to make access to the cable-chute element 11 easier. A locking arrangement, not illustrated in detail, can be provided, by means of which the desk top 20 (not illustrated in FIGS. 8 and 9) connected to the carrier rail 22 is locked in its position of use, for example, the position shown in FIG. 1.

The invention is not limited to the illustrated exemplary embodiments, rather many possibilities for modifications and variations exist for the man skilled in the art, in particular with respect to the development of the components and their mounting on the longitudinal girder.

The embodiments of the invention in which an exclusive property or privilege is claimed are defined as follows:

1. A work-station arrangement comprising a longitudinal girder having a rectangular substantially hollow cross-sectional profile with longitudinal grooves constructed at its corners, which longitudinal grooves extend toward the inside of the longitudinal girder, holding elements received in respective said longitudinal grooves, a desk structure connected to said holding elements, and said holding elements including hook-shaped means received in said longitudinal grooves and engaged with said longitudinal girder for supporting said holding elements fixedly on said longitudinal girder.

2. The arrangement according to claim 1, wherein each longitudinal groove is dimensioned such, that two of said holding elements can be simultaneously inserted therein and suspended in tangential relationship with a common plane, said common plane being oriented transversely with respect to the rectangular cross-sectional profile of the longitudinal girder.

3. The arrangement according to claim 1, wherein said desk structure is connected to at least two of said holding elements, which can be suspended in adjacent longitudinal grooves.

4. A work-station arrangement comprising a longitudinal girder having a rectangular substantially hollow cross-sectional profile with longitudinal grooves constructed at its corners, which longitudinal grooves extend toward the inside of the longitudinal girder, hook-shaped holding elements received in respective said grooves, and a work-station component connected to said holding elements, wherein the longitudinal girder is provided with, in the center of at least one side surface thereof, a fastening groove extending in the longitudinal direction, the walls of which groove are provided with a longitudinal tooth system for facilitating screwing in thread bolts.

5. A work-station arrangement comprising a longitudinal girder having a rectangular substantially hollow cross-sectional profile with longitudinal grooves constructed at its corners, which longitudinal grooves extend toward the inside of the longitudinal girder, hook-shaped holding elements received in respective said grooves, and a work-station component connected to said holding elements, wherein in the center area of the longitudinal girder there is arranged a support pipe connected to the outer walls of said longitudinal girder by means of bracings and extending over the entire length of the longitudinal girder.

6. The arrangement according to claim 1, wherein the longitudinal girder has on its inside at least one holding groove extending over its length.

7. A work-station arrangement comprising a longitudinal girder having a rectangular substantially hollow cross-sectional profile with longitudinal grooves constructed at its corners, which longitudinal grooves extend toward the inside of the longitudinal girder, hook-shaped holding elements received in respective said grooves, and a work-station component connected to said holding elements, wherein the longitudinal girder has on its inside at least one holding groove extending over its length, and wherein the holding groove has a partially circular cross section.

8. The arrangement according to claim 1, wherein a first said holding element is fixedly mounted on said desk structure, while a second said holding element associated with said first holding element is releasably supported on said desk structure.

9. The arrangement according to claim 1, wherein first and second said holding elements each are releasably arranged on said desk structure.

10. The arrangement according to claim 1, including at least one pedestal attached to the underside of the longitudinal girder.

11. The arrangement according to claim 1, including at least one cabinet element supported on the underside of the longitudinal girder.

12. The arrangement according to claim 1, including a cable-chute element supported on the backside of the longitudinal girder.

13. A work-station arrangement comprising a longitudinal girder having a rectangular substantially hollow cross-sectional profile with longitudinal grooves constructed at its corners, which longitudinal grooves extend toward the inside of the longitudinal girder, hook-shaped holding elements received in respective said grooves, and a cable-chute element connected to said holding elements to be supported on the backside of the longitudinal girder, wherein the cable-chute element includes a back-wall element connected to the longitudinal girder by said holding elements, a bottom element connectable to said back-wall element, and a tiltable lid element supported on the back-wall element by means of a hinge.

14. The arrangement according to claim 13, wherein the back-wall element, the bottom element and the lid element are connected by means of a support element at least partly supporting said lid element.

15. The arrangement according to claim 13, wherein the bottom element includes several cable channels separate from one another.

16. The arrangement according to claim 4, including a shelf supported on the underside of the longitudinal girder by means of thread bolts inserted into the fastening groove.

17. The arrangement according to claim 1, wherein said desk structure includes a desk top and a supporting bracket for supporting said desk top, the supporting bracket being fastened by said holding elements on the upper side of the longitudinal girder.

18. The arrangement according to claim 1 wherein said desk structure includes a desk top and a supporting bracket for supporting said desk top, the supporting bracket being secured by said holding elements on the front side of the longitudinal girder.

19. A work-station arrangement comprising a longitudinal girder having a rectangular substantially hollow cross-sectional profile with longitudinal grooves constructed at its corners, which longitudinal grooves extend toward the inside of the longitudinal girder, hook-shaped holding elements received in respective said grooves, and a supporting bracket connected to said holding elements for supporting a desk top, the supporting bracket being secured by said holding elements on the front side of the longitudinal girder, wherein the supporting bracket includes several selectively vertically arranged superposed spacer elements for elevational adjustment of said supporting bracket.

20. A work-station arrangement comprising a longitudinal girder having a rectangular substantially hollow cross-sectional profile with longitudinal grooves constructed at its corners, which longitudinal grooves extend toward the inside of the longitudinal girder, hook-shaped holding elements received in respective said grooves, a supporting bracket connected to said holding elements, and a desk top supported on said supporting bracket, the supporting bracket being fastened by said holding elements on the upper side of the longitudinal girder, and a support rail supported on the supporting bracket to the movable in its longitudinal direction, which support rail is connected to said desk top.

21. The arrangement according to claim 20, wherein the support rail is supported by means of a roller-cage guideway on the supporting bracket.

22. The arrangement according to claim 12, including a channel element arranged vertically below the cable-chute element and adjoining same.

23. The arrangement according to claim 5, including clamping elements insertable into free end areas of the support pipe, which clamping elements support a mounting frame extending above the longitudinal girder.

* * * * *